United States Patent [19]

Jacobs et al.

[11] Patent Number: 5,061,961

[45] Date of Patent: Oct. 29, 1991

[54] DIELECTRIC MEMBER CORE SUPPORT AND LOCATING DEVICE

[75] Inventors: Michael E. Jacobs, Henrietta; Douglas A. Hons, Rochester, both of N.Y.

[73] Assignee: Eastman Kodak Company, Rochester, N.Y.

[21] Appl. No.: 562,346

[22] Filed: Aug. 3, 1990

[51] Int. Cl.[5] ..... G03G 5/00

[52] U.S. Cl. ..... 355/212; 355/200

[58] Field of Search ..... 355/210, 200, 212, 72

[56] References Cited

U.S. PATENT DOCUMENTS

| | | | |
|---|---|---|---|
| 3,606,532 | 9/1971 | Shelffo et al. | 355/212 |
| 4,547,059 | 10/1985 | Nagayama et al. | 355/212 |
| 4,563,077 | 1/1986 | Komada | 355/212 |
| 4,804,993 | 2/1989 | Kenin et al. | 355/212 |

*Primary Examiner*—A. T. Grimley
*Assistant Examiner*—Shuk Y. Lee
*Attorney, Agent, or Firm*—Lawrence P. Kessler

[57] ABSTRACT

In an electrostatographic apparatus including a housing having a lower portion containing electrostatographic process stations and an upper portion connected thereto containing a dielectric member supported on a core, the upper housing portion is movable relative to the lower housing portion to a first (closed) position where the dielectric member is in operative relation to such electrostatographic process stations and a second (open) position wherein the dielectric member is remote from such electrostatographic process stations to enable ready access to such process stations. The dielectric member core is mounted in the upper housing portion for movement with the upper housing portion or movement relative thereto to a position intermediate the upper and lower housing portions when the upper portion is in its second position. A core support and locating device includes a plate member having a surface with a profile which supports the dielectric member core when the core is in its intermediate position, and guides the core automatically into its position for moement with the upper housing portion when the upper housing portion is moved to its first position.

5 Claims, 6 Drawing Sheets

DIELECTRIC MEMBER CORE SUPPORT AND LOCATING DEVICE

BACKGROUND OF THE INVENTION

This invention is directed in general to electrostatographic reproduction apparatus, and more particularly to a device for locating and supporting a dielectric member core of an electrostatographic apparatus for removal and replacement of the dielectric member, and guiding the core for properly locating the dielectric member automatically when the reproduction apparatus is in its operative state.

Electrostatographic reproduction apparatus, and particularly electrophotographic apparatus, typically reproduce information by exposing a uniformly charged dielectric member to an image of information. For example, a light image of information to be reproduced modifies the uniform charge on the photoconductive surface of a dielectric member so as to form a charge pattern, or latent image, on the surface corresponding in an image-wise configuration to the information to be reproduced. Pigmented marking particles, exhibiting a charge of opposite polarity to that of the latent image charge pattern, are brought into contact with the photoconductive surface and adhere to the areas of the surface where the charge pattern exists to develop the latent image and form a transferable image. Thereafter, the transferable image is transferred to a receiver member and permanently fixed to such member by heat and/or pressure to form the desired reproduction.

The dielectric member, in the form of a continuous belt or drum for example, must be accurately locatable relative to the electrostatographic process stations, and at the same time, must be accessible for ready removal and replacement. Further, the electrostatographic process stations must be readily accessible for station adjustment, replacement, or clearing of receiver member jams.

U.S. Pat. No. 4,803,511 (issued Feb. 7, 1989 in the name of Izzo) shows an electrophotographic reproduction apparatus where the dielectric member is supported on a core mounted in a movable upper portion of the reproduction apparatus housing for movement with the upper housing portion such that the electrostatographic process stations in a lower housing portion are accessible, or movement relative to the upper housing portion to an intermediate position to facilitate dielectric member removal and replacement. A sliding plate assembly is provided for the purpose of preventing closing of the movable upper housing portion with the lower housing portion when the dielectric member core is in the intermediate position. Accordingly, an additional step must be taken to return the dielectric member core to its position for movement with the upper housing portion before the upper housing portion can be brought into operative association with the electrostatographic process stations in the lower housing portion. If an attempt is inadvertently made to close the upper portion, many elements of the reproduction apparatus are subject to potential damage.

SUMMARY OF THE INVENTION

This invention is directed to an electrostatographic apparatus including a housing having a lower portion containing electrostatographic process stations and an upper portion connected thereto containing a dielectric member supported on a core. The upper housing portion is movable relative to the lower housing portion to a first (closed) position where the dielectric member is in operative relation to such electrostatographic process stations and a second (open) position wherein the dielectric member is remote from such electrostatographic process stations to enable ready access to such process stations. The dielectric member core is mounted in the upper housing portion for movement with the upper housing portion or movement relative thereto to a position intermediate the upper and lower housing portions when the upper portion is in its second position. A core support and locating device includes a plate member having a surface with a profile which supports the dielectric member core when the core is in its intermediate position, and guides the core automatically into its position for movement with the upper housing portion when the upper housing portion is moved to its first position.

According to a preferred embodiment of this invention, the upper housing portion includes a frame pivotally connected to the lower housing portion, and a dielectric member core supporting the dielectric member. The dielectric member core is coupled to the frame for movement therewith, or for movement relative to the frame to locate the dielectric member on the core in the intermediate position. A dielectric member core support and locating device includes a plate member having a surface with a profile which supports the dielectric member core when the core is in its intermediate position, and guides the core into its position for movement with the upper housing portion when the upper housing portion is moved to its first position.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
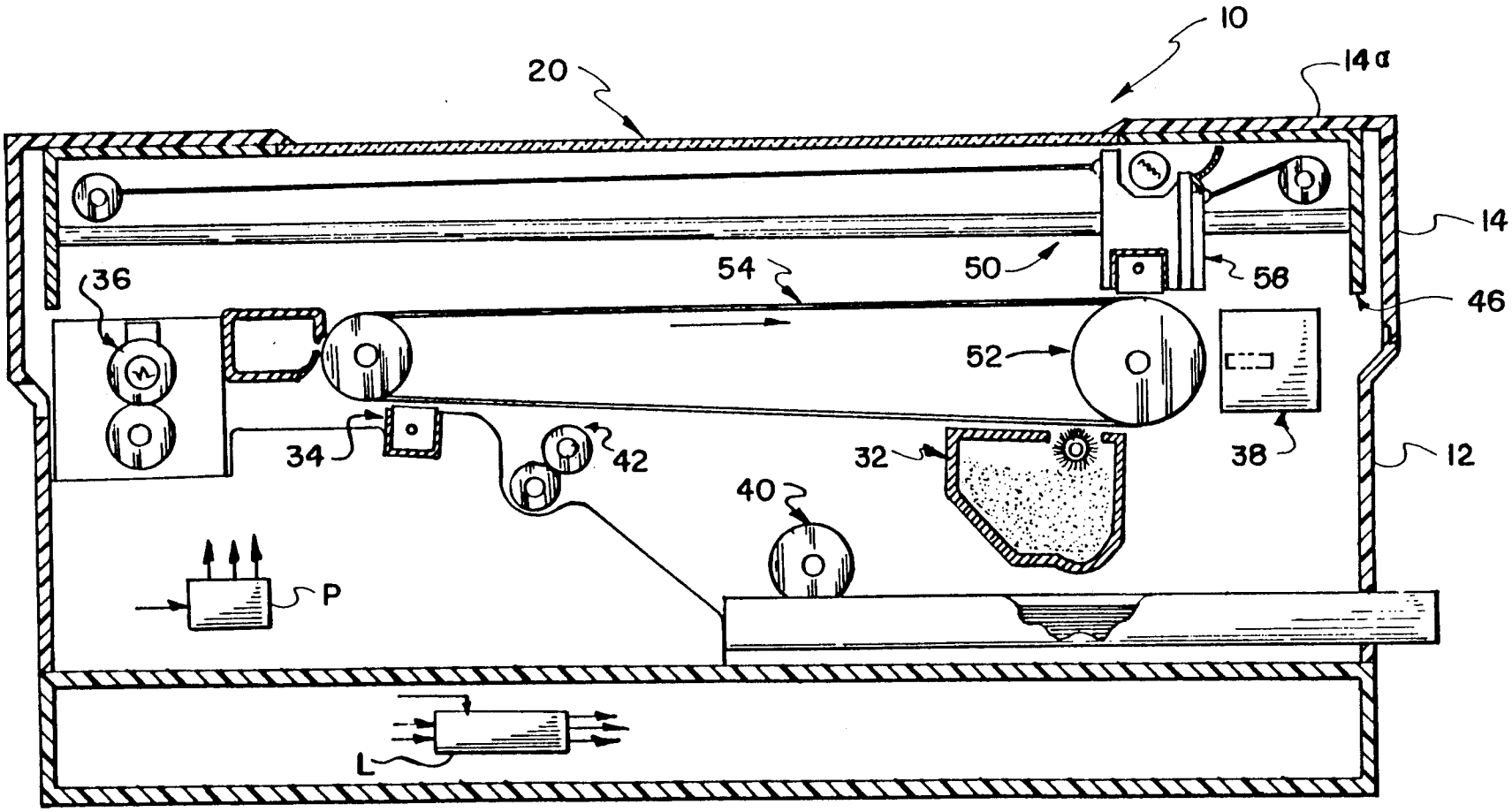
FIG. 1 is a front elevational view of a typical electrostatographic reproduction apparatus, in cross-section, and with portions broken away or removed to facilitate viewing.
Figure 2:
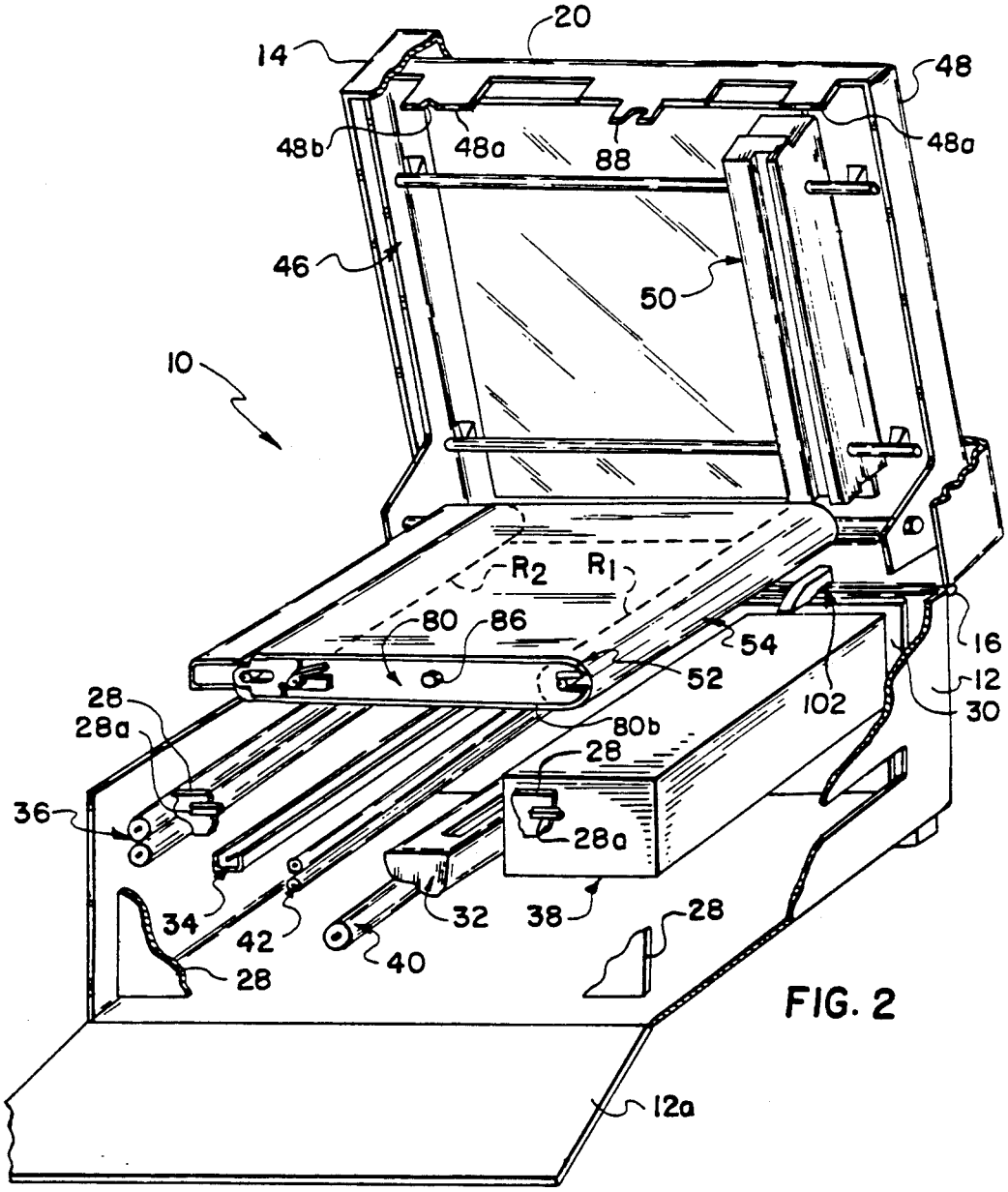
FIG. 2 is a view, in perspective, of the electrostatographic reproduction apparatus of FIG. 1 in a position to enable ready access to the apparatus interior, and with portions broken away or removed to facilitate viewing.

Referring now to the accompanying drawings, FIGS. 1 and 2 show an electrostatographic reproduction apparatus, designated generally by the numeral 10. Of course, the reproduction apparatus 10 is only exemplary, and this invention is suitable for use with other electrostatographic reproduction apparatus. The reproduction apparatus 10 and its operation, which are fully disclosed in U.S. Pat. No. 4,803,517, issued Feb. 7, 1989, in the name of Bruce, Jr., are described herein only in such detail as to permit a full understanding of this invention. Particularly, the reproduction apparatus 10 includes a housing H having a lower portion 12 and an upper portion 14 interconnected by a hinge mechanism 16. The lower and upper housing portions 12, 14 are retained in a closed relation by a latch (not shown), with release of the latch enabling the portions to be opened to permit access to the interior of the apparatus 10 (see FIG. 2). The upper portion 14 has a transparent platen 20, formed in the top surface 14*a* thereof, for supporting a document to be optically reproduced. An opaque cover member (not shown) is connected to the upper portion 14 for covering a document placed on the platen 20 for optical reproduction. A front panel 12*a* of the lower portion 12 of the housing H is opened to provide access to the interior of the apparatus 10.

The operation of the reproduction apparatus 10 is controlled by a logic and control unit L for setting operating parameters for the apparatus and monitoring its functions. The logic and control unit L includes, for example, a microprocessor receiving operator input signals and timing signals. Based on such signals and a program from the microprocessor, the unit L produces signals to control the operation of the apparatus 10 for carrying out the reproduction process. The production of the program for a number of commercially available microprocessors such as an INTEL Model 8080 or Model 8085 microprocessor (which along with others are suitable for use with this invention) is a conventional skill well understood in the art. The particular details of any such program would, of course depend on the architecture of the designated microprocessor.

A pair of oppositely disposed machine plates 28, 30, are located within the lower portion 12 of the housing H. The plates serve to locate, and relatively position, various elements utilized in the electrostatographic process for image reproduction. Such elements include, for example, a magnetic brush developer station 32, a transfer charger 34, and a heat/pressure fuser assembly 36. Additionally, the plates support a mechanism 38 for reproducing electronically generated information, a receiver member feed mechanism 40, and receiver member registration mechanism 42. Further, a drive assembly is supported by the rear plate 30. The drive assembly includes a motor, gear train and a plurality of clutches inter-related in a well known manner for effecting operation of various components and elements of the reproduction apparatus 10. Of course, other drive assemblies, such as belts and pulleys, are suitable for use with this invention.

The upper portion 14 of the housing H contains a supporting member 46 in the form of a rigid frame 48. The frame serves to locate and relatively position an optical exposure assembly 50 and a core assembly 52 for supporting a photoconductive belt 54. The photoconductive belt 54 is a composite dielectric member including a typical photoconductive material layer such as shown, for example, in U.S. Pat. No. 3,615,41, issued Oct. 26, 1971 in the name of Light. Of course, other organic or inorganic photoconductive materials are suitable for use with this invention.

Figure 5:
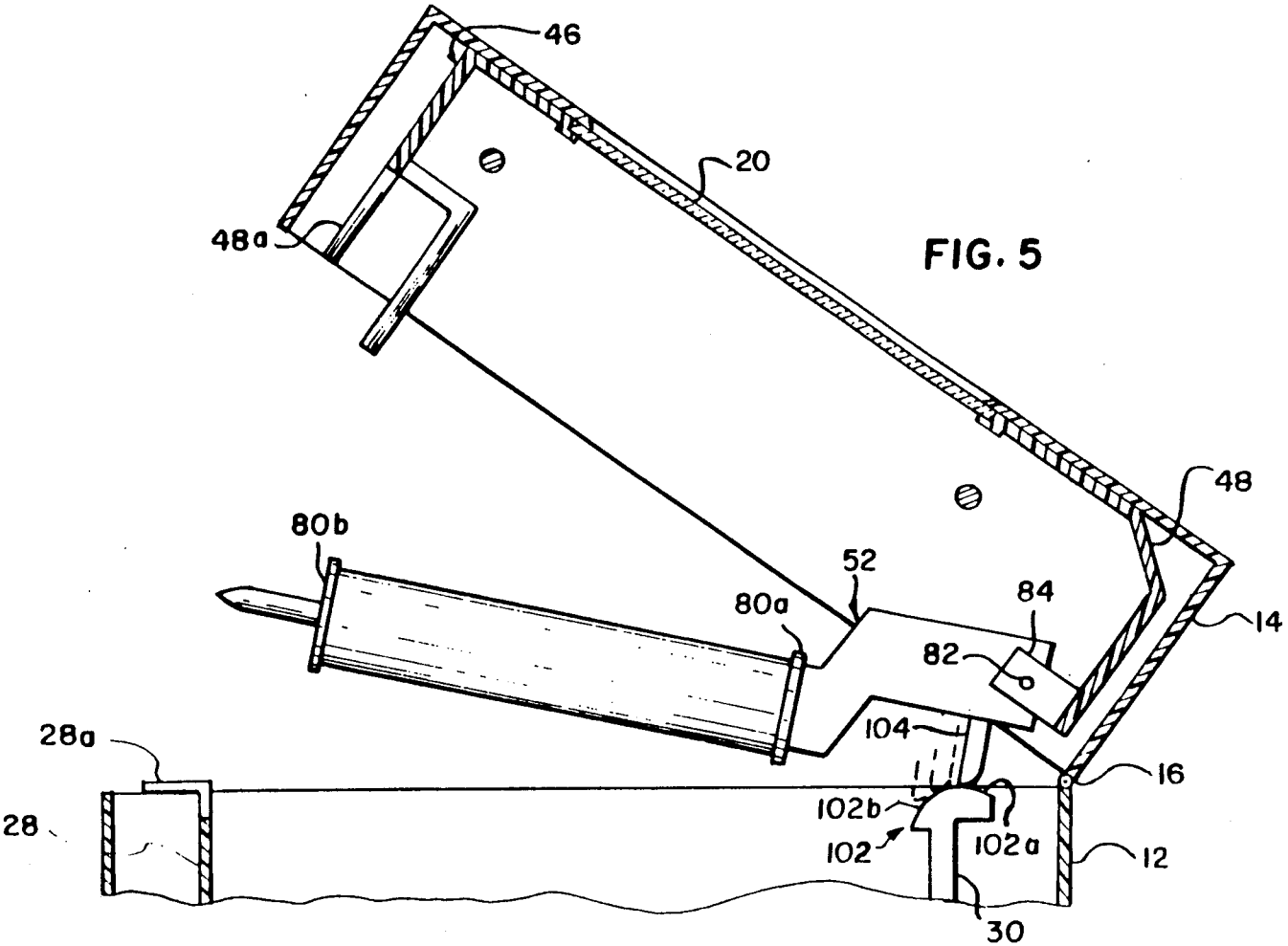
FIG. 5 is an end elevational view of the dielectric member core, and its support and locating device, similar to FIG. 4, in its position to enable the dielectric member to be readily removed and replaced.
Figure 6:
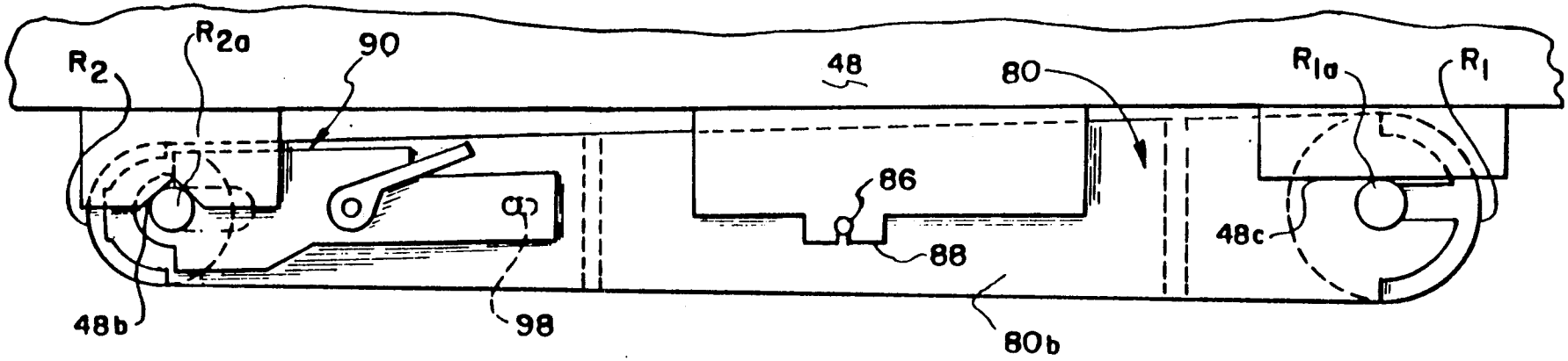
FIG. 6 is a front elevational view of the dielectric member core including a latching mechanism, partly in cross-section and with portions broken away or removed to facilitate viewing.

Detail of the core assembly 52 for supporting the photoconductive belt 54 is best shown in FIG. 6. Such core assembly comprises a pair of rollers $R_1$, $R_2$ supported by a torque frame 80. The torque frame 80, which maintains the rollers $R_1$, $R_2$ in substantial relative alignment, is in turn supported at its rearwardly facing end 80*a* on a pivot shaft 82 carried by a portion 84 of the rigid frame 48 of the supporting member 46 (see FIGS. 3–5). The forwardly facing end 80*b* of the torque frame has a pin 86 extending outwardly therefrom. The pin 86 is adapted to be engaged by a latching mechanism 88 carried by the rigid frame 48. Such engagement releasably retains the core assembly 52 in the supporting member 46 for selective movement with the upper housing portion 14.

Figure 3:
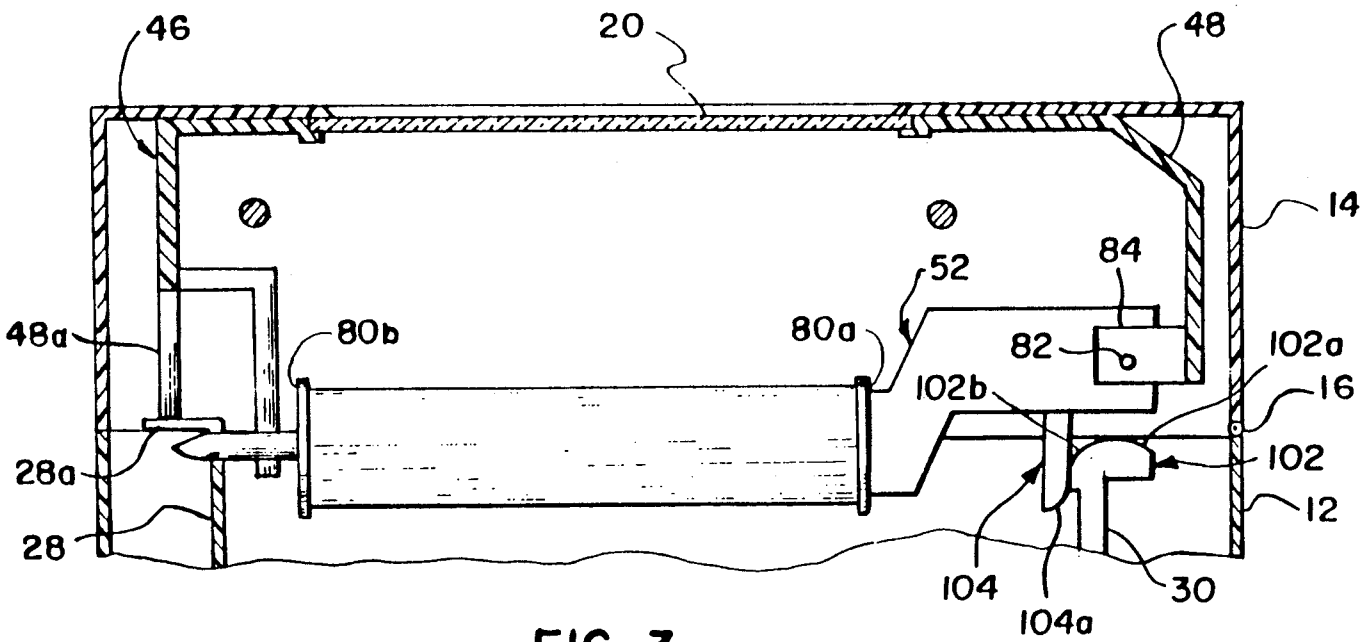
FIG. 3 is an end elevational view of the dielectric member core, and its support and locating device according to this invention, in its operative position, partly in cross-section and with portions broken away or removed to facilitate viewing.

As shown in FIG. 3, with the upper housing portion 14 closed and the core assembly 52 latched to the rigid frame 48, the photoconductive belt 54 is precisely positioned relative to the transparent platen 20 and the lower housing portion 12 (and thus the electrostatographic process stations therein). When the upper housing portion 14 is pivoted about hinge 16 to its open position, the latched core assembly 52 is raised with the upper housing portion (see FIG. 4) to enable easy access to the interior of the reproduction apparatus. Thereafter, the latching mechanism 88 may be released to enable the torque frame 80 to pivot about the shaft 82 to move the core assembly 52 to an intermediate position (see FIG. 5) where removal and replacement of the photoconductive belt 54 is facilitated.

Figure 4:
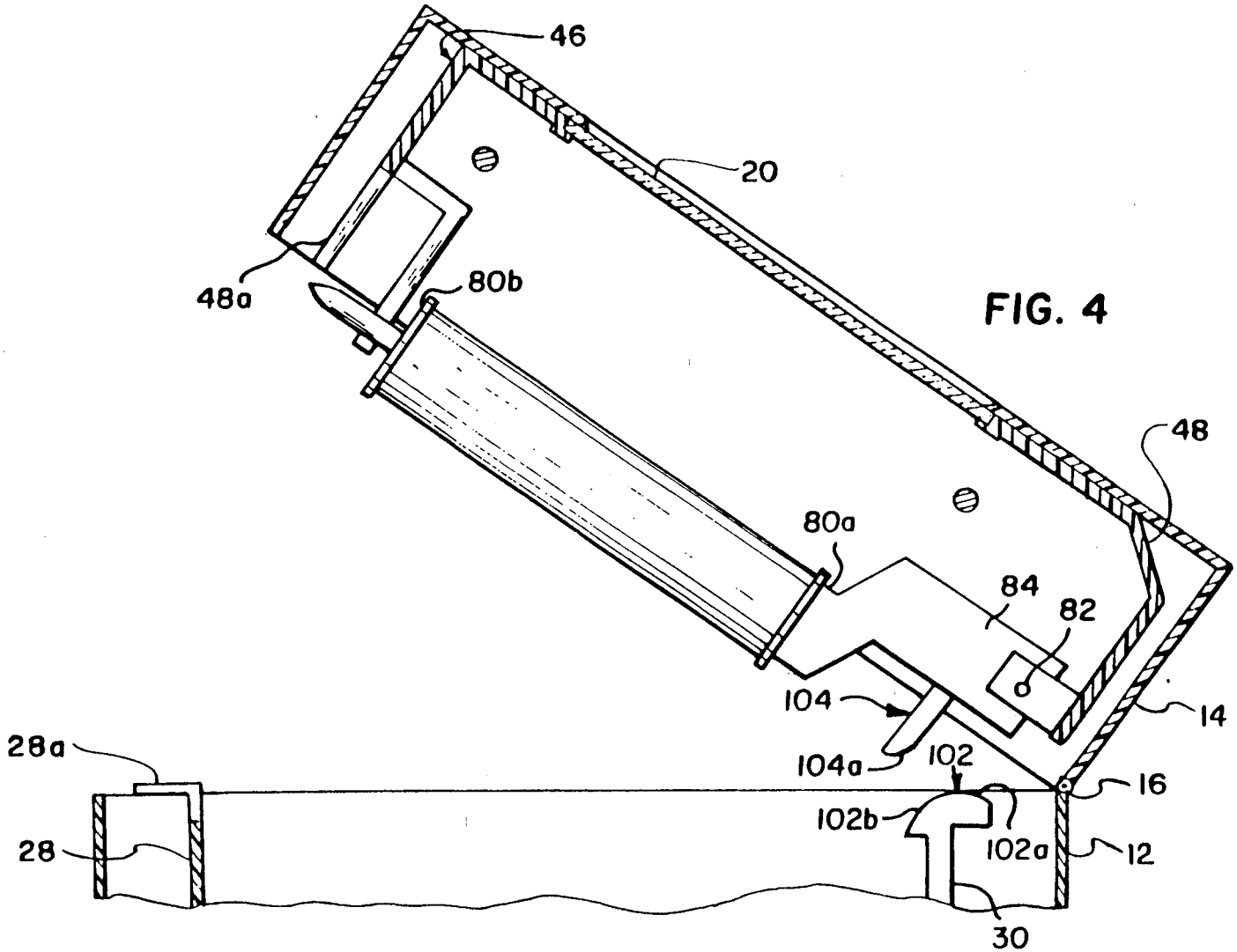
FIG. 4 is an end elevational view of the dielectric member core, and its support and locating device, similar to FIG. 4, in its position to permit access to the interior of the reproduction apparatus.

When the torque frame 80 is moved to its intermediate position, it is desirable to accurately locate such frame in a position so that the photoconductive belt can be replaced without touching any portion of the reproduction apparatus 10 in order to prevent damage to the new belt. This invention provides a core support and locating device assembly to support and accurately locate the torque frame 80 when in its intermediate position. The core support and locating device assembly, as best shown in FIGS. 3–5, includes at least one extension piece 102 attached to machine plate 30. Although only one extension piece is shown in the accompanying drawings, it is readily understood that plural extension pieces spaced at selected intervals along the top surface of the plate 30 may be employed as deemed necessary.

The extension piece 102 has a surface profile for selectively locating and supporting the core assembly 52 and guiding movement thereof. Specifically, the piece has a substantially flat upper surface 102*a* and a sloping side wall 102*b*. A follower member 104 (corresponding plural follower members if plural extension pieces are provided), attached to the torque frame 80 between the rearwardly facing end 80*a* and the pivot shaft 82, is adapted to cooperate in a cam-like fashion with the extension piece 102. As best shown in FIG. 5, the follower member 104 has a surface 104*a* which engages surface 102*a* of the extension piece when the core assembly 52 is unlatched from the upper housing portion 14 and allowed to move to its intermediate position. Such engagement accurately locates and maintains the core assembly in its intermediate position so that the photoconductor belt 54 can be readily replaced in a manner which substantially assures that the belt will not come into potentially damaging contact with elements of the reproduction apparatus.

The profile for the surface 102*b* of the extension piece 102 is particularly specified and the location of the longitudinal axis of the pivot shaft 82 relative to the longitudinal axis of the hinge 16 is specifically determined. Accordingly, when the upper housing portion is closed (without the necessity of returning the core assembly 52 to its latched position relative to the upper housing portion), the surface 104*a* of the follower 104 rides on the sloping surface 102*b* of the extension piece 102 (see broken line showing in FIG. 5). The cooperation between the follower member 104 and the extension piece 102 automatically guides the core assembly 52 without potential damage into a proper location where the core assembly is relatched to the frame 48 as the upper housing portion 14 is brought into its closed position (operative association with the lower housing 12).

With the described electrostatographic reproduction apparatus, the core assembly support and locating device, according to this invention, enables the photoconductive belt (dielectric member) of the reproduction apparatus to be accurately located and supported for removal and replacement. Further, such assembly assures that during movement of the upper housing portion of the reproduction apparatus from its open (remote) position to its closed (operative position), the dielectric member core assembly is automatically guided from its intermediate position to its proper position relative to the upper housing portion.

The invention has been described in detail with particular reference to a preferred embodiment thereof, but it will be understood that variations and modifications can be effected within the spirit and scope of the invention.

We claim:

1. In an electrostatographic reproduction apparatus including a housing having a lower portion containing electrostatographic process stations and an upper portion connected thereto containing a dielectric member supported on a core, said upper housing portion being movable relative to said lower housing portion to a first position where said dielectric member is in operative relation to such electrostatographic process stations and a second position wherein said dielectric member is remote from such electrostatographic process stations to enable ready access to such process stations, said dielectric member core being movale with said upper housing portion or relative to said upper housing portion to a position intermediate said upper and lower housing portions when said upper portion is in its second position, a dielectric member core support and locating device comprising means for supporting said dielectric member core when said core is in its intermediate position, and guiding said core for automatic location into its position for movement with said upper housing portion when said upper housing portion is moved to its first position.

2. The invention of claim 1 wherein said supporting and locating means includes a plate member in said lower housing portion, and a follower member connected to said core adapted to engage said plate member when said core is in its intermediate position.

3. The invention of claim 2 wherein said plate member has an extension piece defining a profiled surface, and said follower member has a surface adapted to follow said profiled surface when engaged therewith.

4. The invention of claim 3 wherein said profiled surface has a substantially flat portion adapted to support and accurately locate said core when said follower surface of said member engages said flat portion, and a sloping portion adapted to guide movement of said core when said follower surface engages said sloping portion as said upper housing portion is moved from its second position to its first position.

5. In an electrostatographic reproduction apparatus including a housing having a lower portion containing electrostatographic process stations and an upper portion containing a dielectric member supported on a core, said upper housing portion being connected to said lower housing portion by a hinge mechanism for enabling said upper portion to be pivotably movable to a first position where said dielectric member is in operative relation to such electrostatographic process stations and a second position wherein said dielectric member is remote from such electrostatographic process stations to enable ready access to such process stations, said dielectric member core being pivotably connected to said upper housing portion for selective pivotable movement about a longitudinal axis spaced from and parallel to the longitudinal axis of said hinge mechanism so that said core is movable with said upper housing portion or relative to said upper housing portion to a position intermediate said upper and lower housing portions when said upper portion is in its section position, a dielectric member core support and locating device comprising:

a plate member in said lower housing portion; at least one extension piece connected to said plate; at least one follower member connected to said core adapted to engage said extension piece when said core is in its intermediate position; said extension piece having a profiled surface with a substantially flat portion adapted to support and accurately locate said core when said follower member engages said flat portion, and a sloping portion adapted to guide movement of said core rotating about its pivot axis when said follower member engages said sloping portion as said upper housing portion is moved about its hinge axis from its second position to its first position.

* * * * *